United States Patent [19]

Roldan

[11] 4,418,874

[45] Dec. 6, 1983

[54] METHOD AND APPARATUS FOR STORING A LENGTH OF WEB

[75] Inventor: Bayani E. Roldan, Pasadena, Calif.

[73] Assignee: Bell & Howell Company, Chicago, Ill.

[21] Appl. No.: 302,872

[22] Filed: Sep. 16, 1981

[51] Int. Cl.[3] ..... B65H 27/00

[52] U.S. Cl. ..... 242/76; 242/DIG. 3, 209/920

[58] Field of Search ..... 242/76, 55, DIG. 3, 242/71-71.2; 400/578, 579, 603, 613, 613.1, 614, 617, 619, 621, 624-625; 40/341-346; 226/196-198; 209/633, 920, 921

[56] References Cited

U.S. PATENT DOCUMENTS

| | | | |
|---|---|---|---|
| 1,096,027 | 5/1914 | Farnham et al. . | |
| 1,563,113 | 11/1925 | Smith . | |
| 1,821,922 | 9/1931 | Becker . | |
| 1,929,449 | 10/1933 | Trego . | |
| 2,047,359 | 7/1936 | Dayment et al. . | |
| 2,650,775 | 9/1953 | Roche . | |
| 3,447,657 | 6/1969 | Majors . | |
| 3,670,982 | 6/1972 | Henry | 242/71.2 |
| 3,715,963 | 2/1973 | Le Cover | 242/71.1 X |
| 3,900,098 | 8/1975 | Effinger . | |
| 4,043,440 | 8/1977 | Busch | 400/620 |
| 4,065,068 | 12/1977 | Treadwell . | |
| 4,138,018 | 2/1979 | Daebler et al. | 209/633 |

FOREIGN PATENT DOCUMENTS

| | | | |
|---|---|---|---|
| 1231214 | 5/1971 | United Kingdom | 242/DIG. 3 |

*Primary Examiner*—Leonard D. Christian

*Attorney, Agent, or Firm*—Benoit Law Corporation

[57] ABSTRACT

Methods and apparatus for storing a length of web push the web from such length into a coiled form, whereby adhesion tends to develop between turns of the web in the coiled form, effectively limiting attainable minimum web coil diameter. According to the invention, such adhesion is broken up at least intermittently and web is continued to be pushed into the coiled form to reduce the web coil diameter and accommodate the entire length of web in the coiled form. The mentioned breaking up may include changing static friction between turns of the web to dynamic friction and/or shaking the turns of the web at least intermittently. Where a curved recipient is employed for prompting the web into a coiled form, an electromagnetic vibrator having a plunger acting on the curved recipient at least intermittently may be employed. An aspect of the invention imposes on the web a curl assisting coiling thereof in a housing.

15 Claims, 1 Drawing Figure

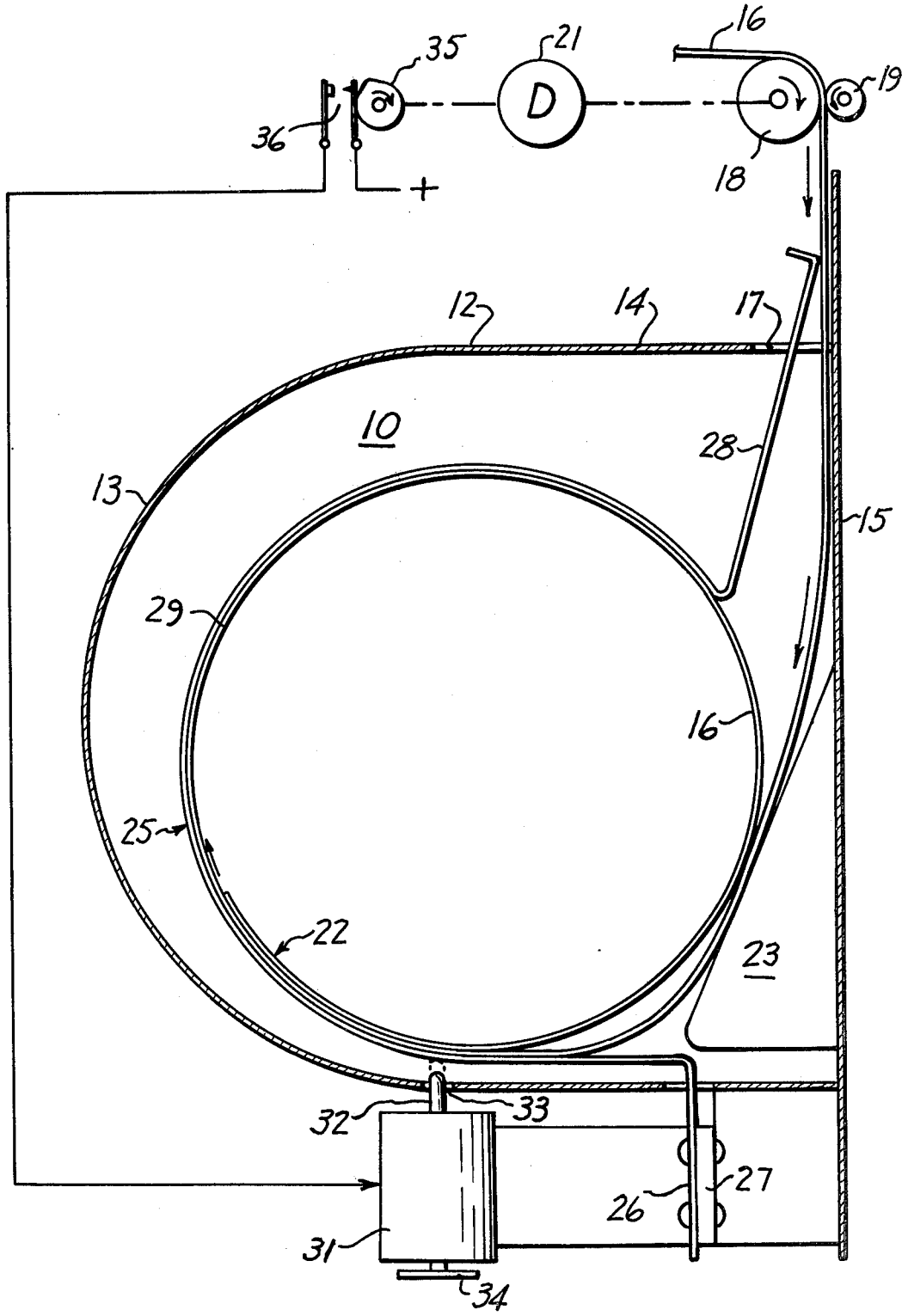
16
35
21
19
D
36
18
+
12
14
17
10
28
13
15
29
16
25
22
23
32
33
27
26
31
34

METHOD AND APPARATUS FOR STORING A LENGTH OF WEB

BACKGROUND OF THE INVENTION

1. Field of the Invention

The subject invention relates to methods and apparatus for storing webs and, more specifically, to such methods and apparatus which push the web into a coiled form for storage or other purposes. The expression "web" as herein employed may, for instance, include paper, foil, tape, film or other web or web-like materials.

2. Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

Systems for storing lengths of webs may, by way of example, be broadly divided into those which wind the web on a roller or similar device and those which introduce the web into a receptacle therefor.

Reference may in this respect be had to U.S. Pat. No. 1,096,027, by S. H. Farnham et al, issued May 12, 1914, in which paper from a typewriter is introduced into a basket having a sprocketed roller at the bottom thereof, U.S. Pat. No. 1,563,113, by J. A. B. Smith, issued Nov. 24, 1925, and employing typical feed rollers in conjunction with a platen, U.S. Pat. No. 1,821,922, by F. Becker, issued Sept. 8, 1931, and showing a tubular member for receiving a rolled-up record sheet, U.S. Pat. No. 1,929,449, by F. H. Trego, issued Oct. 10, 1933 and showing also a tubular container for a coiled work sheet, U.S. Pat. No. 2,047,359, by L. E. Dayment et al, showing a tubular container for a coiled sheet in printing apparatus, U.S. Pat. No. 2,650,775, by J. Roche, issued Sept. 1, 1953 and disclosing a portable rewinder for paper tape from business machines employing a rewinding drum, U.S. Pat. No. 3,447,657, by P. A. Majors, issued June 3, 1969, and disclosing a tape rewinding accessory employing a takeup spool, U.S. Pat. No. 3,900,098, by C. S. Effinger, issued Aug. 19, 1975, and disclosing a channel-like pocket containing coiled paper, U.S. Pat. No. 4,043,440, by R. E. Busch, issued Aug. 23, 1977 and disclosing a paper feed and web rewind mechanism employing a paper rewind roll, and U.S. Pat. No. 4,065,068, by J. W. Treadwell, issued Dec. 27, 1977, and disclosing an adding machine tape reversing rewinder employing a manually operated paper reel.

Systems which employ a windup roller usually have a considerable capacity, but are relatively expensive and require a roller drive arrangement. Systems in which a web is pushed into a receptacle for coiling therein without the aid of a roller have certain advantages, but generally suffer from a limited capacity, since adhesion tends to develop between turns of the web in the coiled form, effectively limiting attainable minimum web coil diameter.

Retrospectively, it may be seen that vibration has been used in the past in material feeding systems. For instance, a proposal according to U.S. Pat. No. 3,038,721, by D. Miller, issued June 12, 1962 employs vibrations from a printing press in the feeding of fabricated material thereto. U.S. Pat. No. 3,545,741, by E. Porth, issued Dec. 8, 1970, discloses a collator with sheet feeders assisted by vibration. U.S. Pat. No. 4,138,018, by D. H. Daebler et al, issued Feb. 6, 1979, discloses methods and apparatus for sorting substrates in which a vibrator is employed for causing substrates to move across a plate vibrated thereby.

However, none of these known systems solves the above mentioned problem of limited web storage capacity.

SUMMARY OF THE INVENTION

It is a general object of the invention to overcome the disadvantages and to meet the needs expressed or implicit in the above disclosure statement or in other parts hereof.

It is a germane object of this invention to provide improved methods and apparatus for storing lengths of webs in coiled form.

It is a related object of this invention to provide methods and apparatus for increasing the capacity of web storing systems in which webs are pushed into a coiled form.

It is a germane object of this invention to reduce attainable web coil diameter and accommodate longer webs in web containers of the type herein disclosed.

Other objects of this invention will become apparent in the further course of this disclosure.

The subject invention resides in methods and apparatus for storing a length of web and, more specifically, resides in the improvement comprising, in combination, the steps of, or means for, imposing on the length of web a curl assisting coiling thereof, pushing web from the mentioned length having the curl imposed thereon into a coiled form, whereby adhesion tends to develop between turns of the web in the coiled form, effectively limiting attainable minimum web coil diameter, and breaking up such adhesion at least intermittently and continuing to push the web into the coiled form to reduce the web coil diameter and accommodate the length of web in the coiled form.

According to a preferred embodiment of the subject invention, the web receiving means include a curved receptacle or recipient for prompting the web into the coiled form, and the means for breaking up adhesion include means coupled to the curved recipient for shaking such recipient at least intermittently. By way of example, an electromagnetic vibrator or similar device having a plunger acting on the curved recipient at least intermittently may be employed.

BRIEF DESCRIPTION OF THE DRAWINGS

The subject invention and its various objects and aspects may become more readily apparent from the following detailed description of preferred embodiments thereof, illustrated by way of example in the accompanying drawing, showing a side view, in section, of an apparatus for storing a length of web according to a preferred embodiment of the subject invention.

DESCRIPTION OF PREFERRED EMBODIMENTS

The web storing apparatus 10 shown in the drawing has a curved housing 12 including a semi-circular portion 13 adjoining a straight portion 14 having an end thereof closed by a plate 15. By way of example, the plate 15 may be a door for the apparatus or may be part of its frame structure.

A strip of paper or another web 16 is pushed into an opening 17 of the housing 12. A drive roller 18 assisted by a nip roller 19 may be employed for this purpose. The strip 16 may proceed over the drive roller 18 through a bent or may otherwise be provided with a certain curl assisting its coiling in the housing 12. In this respect, the illustrated apparatus may, for instance, be employed in conjunction with a printing device or other equipment which issues paper strips having a certain curl imposed thereon.

In the illustrated embodiment, the roller 18 is rotated by a roller drive 21.

The illustrated apparatus pushes web 16 from the length of web to be accommodated therein into a coiled form 22. To this end, the plate or door 15 has a wedge-shaped member 23 mounted at the inside thereof. This member 23 projects into a lower portion of the housing 12, so as to urge the advancing web 16 into the coiled form 22.

In particular, a curved strip of spring material 25 has a first end 26 projecting downwardly through the housing 12 and being attached to part of the apparatus frame structure 27. The curved strip has a second end 28 projecting upwardly through the opening 17 in the housing 12.

If desired, the upper end 28 of the strip 25 may be employed for assisting the guidance of the web 16 into the housing. Of course, the initial angle of inclination of the upper end 28 will be adapted to the frictional and other properties of the web material, so as to avoid blocking thereof.

The strip 25 has a curved portion 29, extending typically over more than a semi-circle, between the ends 26 and 28. The strip 25 thus forms a curved recipient for prompting the web into a coiled form. While such coiled recipients have been found useful in the past, adhesion developing between turns of the web in the coiled form 22 have impeded further advancement of the web into the recipient and have effectively limited attainable minimum web coil diameter and thereby attainable capacity of such web storage apparatus.

According to the illustrated preferred embodiment of the invention, an electromagnetic vibrator or solenoid 31 is connected to the apparatus frame structure 27 adjacent the housing 12. The solenoid 31 has a plunger 32 projecting through an aperture 33 in the housing 12. The solenoid also has an armature 34 by means of which the plunger can be thrust upwardly upon energization of the solenoid. Accordingly, the plunger is made to act on the curved strip or recipient 25 at least intermittently so as to break up adhesion between turns of the web 16 in the coiled form 22.

The plunger 32 may be made to hit the strip 25, thereby changing static friction between turns of the web 16 into lower dynamic friction and otherwise shaking the coiled form 22 for a reduction of the web coil diameter in the coiled form.

In principle, the solenoid or vibrator 31 may be energized with alternating current or pulsed rapidly. However, it has been found that an intermittent energization of the solenoid 31 is sufficient in most cases.

In this respect, the illustrated preferred embodiment energizes the solenoid 31 in synchronism with the web drive 21. By way of example, a cam 35 which intermittently closes a contact pair 36 may be employed for this purpose. The cam 35 may be rotated by the same drive 21 which also rotates the paper drive roller 18. Where the web 16 issues from a printing apparatus or similar device, the pulse for energizing the solenoid may be supplied by such printing apparatus or device, such as in step with a printing operation.

Extensive tests have confirmed that the adhesion breakup system according to the subject invention increases the web-receiving capacity of the illustrated storage apparatus very considerably.

Various modifications and variations within the spirit and scope of the subject invention will be apparent or suggest themselves to those skilled in the art.

I claim:

1. In a method of storing a length of web, the improvement comprising in combination the steps of:

imposing on said length of web a curl assisting coiling thereof;

pushing web from said length having said curl imposed thereon into a coiled form, whereby adhesion tends to develop between turns of said web in the coiled form, effectively limiting attainable minimum web coil diameter; and breaking up said adhesion at least intermittently and continuing to push said web into the coiled form to reduce said web coil diameter and accommodate said length of web in the coiled form.

2. A method as claimed in claim 1, wherein:

said breaking up includes changing static friction between turns of said web to dynamic friction.

3. A method as claimed in claim 1 or 2, wherein:

said breaking up includes shaking said turns of web at least intermittently.

4. In apparatus for storing a length of web, the improvement comprising in combination:

means for receiving said web in a hollow space and for prompting said web into a coiled form, whereby adhesion tends to develop between turns of said web in the coiled form, effectively limiting attainable minimum web coil diameter;

means for breaking up said adhesion at least intermittently; and means for pushing said length of web into said receiving means to form a coil of said web having a minimum diameter smaller than said limited diameter, including means for imposing on said length of web a curl assisting coiling thereof.

5. Apparatus as claimed in claim 4, wherein:

said means for breaking up adhesion include means for changing static friction between turns of said web to dynamic friction.

6. Apparatus as claimed in claim 4 or 5, wherein:

said means for breaking up adhesion include means for shaking said turns of web at least intermittently.

7. Apparatus as claimed in claim 4 or 5, wherein:

said means for breaking up adhesion include means coupled to said receiving means for shaking said receiving means at least intermittently.

8. Apparatus as claimed in claim 4 or 5, wherein:

said receiving means include a curved recipient for prompting said web into a coiled form; and said means for breaking up adhesion include means coupled to said curved recipient for shaking said recipient at least intermittently.

9. Apparatus as claimed in claim 8, wherein:

said means for shaking said recipient include an electromagnetic vibrator having a plunger acting on said curved recipient at least intermittently.

10. In apparatus for storing a length of web, the improvement comprising in combination:

means for receiving said web in a hollow space and for prompting said web into a coiled form, whereby adhesion tends to develop between turns of said web in the coiled form, effectively limiting attainable minimum web coil diameter;

means for breaking up said adhesion at least intermittently, including means for shaking said turns of web at least intermittently; and means for pushing said length of web into said receiving means to form a coil of said web having a minimum diameter smaller than said limited diameter.

11. Apparatus as claimed in claim 10, wherein:

said shaking means include means coupled to said receiving means for shaking said receiving means at least intermittently.

12. Apparatus as claimed in claim 10, wherein:

said receiving means include a curved recipient for prompting said web into a coiled form; and said shaking means include means coupled to said curved recipient for shaking said recipient at least intermittently.

13. Apparatus as claimed in claim 12, wherein:

said curved recipient has an end projecting through an opening in said receiving means for assisting a guidance of said web into said receiving means.

14. Apparatus as claimed in claim 10, wherein:

said receiving means include a curved recipient for prompting said web into a coiled form; and said shaking means include an electromagnetic vibrator having a plunger acting on said curved recipient at least intermittently.

15. In a method of storing a length of web, the improvement comprising in combination the steps of:

pushing web from said length into a coiled form, whereby adhesion tends to develop between turns of said web in the coiled form, effectively limiting attainable minimum web coil diameter; and breaking up said adhesion by shaking said turns of web at least intermittently and continuing to push said web into the coiled form to reduce said web in the coiled form.

* * * * *